US008134440B2

(12) United States Patent
Beckenbach et al.

(10) Patent No.: US 8,134,440 B2
(45) Date of Patent: Mar. 13, 2012

(54) PLANAR-HELICAL UNDULATOR

(75) Inventors: Max Beckenbach, Stutensee (DE); Theo Schneider, Eggenstein-Leopoldshafen (DE); Bernd Lott, Eggenstein-Leopoldshafen (DE); Marion Klaeser, Karlsruhe (DE); Matthias Eisele, Karlsruhe (DE); Pauline Leys, Stutensee (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 365 days.

(21) Appl. No.: 12/516,508

(22) PCT Filed: Nov. 16, 2007

(86) PCT No.: PCT/EP2007/009900

§ 371 (c)(1),
(2), (4) Date: May 27, 2009

(87) PCT Pub. No.: WO2008/064779

PCT Pub. Date: Jun. 5, 2008

(65) Prior Publication Data

US 2010/0045410 A1 Feb. 25, 2010

(30) Foreign Application Priority Data

Nov. 28, 2006 (DE) ..... 10 2006 056 052

(51) Int. Cl.

| | |
|---|---|
| ***H01F 5/00*** | (2006.01) |
| ***H01F 7/00*** | (2006.01) |
| ***H01F 1/00*** | (2006.01) |
| ***H01F 6/00*** | (2006.01) |

(52) U.S. Cl. ..... 335/299; 335/216; 335/284; 335/296; 336/225; 315/5.35; 315/501

(58) Field of Classification Search ..... 335/216, 335/284, 296, 299; 336/225; 315/5.34–5.35, 315/501, 503, 507

See application file for complete search history.

(56) References Cited

U.S. PATENT DOCUMENTS 4,523,168 A * 6/1985 Emanuelson et al. ..... 335/296

(Continued)

FOREIGN PATENT DOCUMENTS

DE 10358225 6/2005

(Continued)

OTHER PUBLICATIONS

U. Schindler, "Ein supraleitender Udulator mit elektrisch umschaltbarer Helizitaet", Aug. 2004, Forschungszentrum Karlsruhe in der Helmholz-Gemeinschaft, Wissenschaftliche Berichte, FZKA 6997, XP-002471630, pp. 1-50.

(Continued)

*Primary Examiner* — Mohamad Musleh

(74) *Attorney, Agent, or Firm* — Leydig, Voit & Mayer, Ltd.

(57) ABSTRACT

A planar-helical undulator for emitting 360° electrically variable photo radiation, including a first coil and a second coil disposed relative to an undulator axis, an axis of the first coil and an axis of the second coil and the undulator axis being parallel to each other, and the undulator axis forming a portion of a synchrotron beam axis. Further, each of the first and second coils includes a helical section and a planar section. The windings of each respective section are connected in series, so that the planar section generates, when energized, a first magnetic field, and so that the helical section generates, when energized, a second magnetic field. Each planar section is disposed around the corresponding helical section, and at least one of the helical section and the planar section of at least one of the coils includes variable windings changing symmetrically over a length of the respective section towards a middle of the respective section.

24 Claims, 9 Drawing Sheets

U.S. PATENT DOCUMENTS

| | | | | |
|---|---|---|---|---|
| 4,764,743 | A | 8/1988 | Leupold et al. | |
| 5,079,458 | A | 1/1992 | Schuster et al. | |
| 5,675,304 | A * | 10/1997 | Georgiyevskiy | 335/299 |
| 6,858,998 | B1 | 2/2005 | Shenoy et al. | |
| 6,876,288 | B2 * | 4/2005 | Gavrilin et al. | 336/200 |
| 7,129,807 | B2 | 10/2006 | Rossmanith et al. | |
| 2006/0158288 | A1 * | 7/2006 | Rossmanith et al. | 335/216 |

FOREIGN PATENT DOCUMENTS

| | | |
|---|---|---|
| EP | 0577874 | 1/1994 |
| JP | 06060998 | 3/1994 |
| WO | 2005060322 | 6/2005 |

OTHER PUBLICATIONS

A. Bernhard et al. "Superconducting In-Vacuum Undulators", IEEE Transactions on Applied Superconductivity, vol. 16, No. 2, Jun. 2006, pp. 1836-1839, XP002471628.

A. Bernhard et al. "Superconductive Undulators With Variable Polarization Direction", IEEE Transactions on Applied Superconductivity, vol. 15, No. 2, Jun. 2005, pp. 1228-1231, XP011133961.

E. R. Moog, "Novel Insertion Devices", Proceedings of the 2003 Particle Accelerator Conference, PAC 2003, Portland, OR, May 12-16, 2003, Particle Accelerator Conference, New York, NY, IEEE, US, vol. 1 of 5, pp. 156-160, XP010699612.

A. Bernhard et al. "Planar and Planar Helical Superconductive Undulators for Storage Rings: State of the Art", Proceedings of EPAC 2004, Lucerne, Switzerland, European Particle Accelerator Conference, Jun. 2004, pp. 354-356, XP002471629.

Ivanyushenkov: "Development of a superconducting Helical Undulator for a Polarised Positron Source", CCLRC Rutherford Appleton Laboratory, Workshop on Positron Sources for the International Linear Collider, Daresbury Laboratory, Apr. 11-13, 2005.

Caspi et al.: "Positron Source Undulator", Lawrence Berkely National Laboratory, ILC Meeting, SLAC May 8, 2006; 19 pages.

International Search Report mailed Mar. 31, 2008 during the prosecution of corresponding International Patent Application No. PCT/EP2007/009900; 6 pages.

* cited by examiner

PLANAR-HELICAL UNDULATOR

CROSS REFERENCE TO PRIOR APPLICATIONS

This application is a U.S. National Phase application under 35 U.S.C. §371 of International Application No. PCT/EP2007/009900, filed Nov. 16, 2007, and claims benefit to German Patent Application No. 10 2006 056 052.3, filed Nov. 28, 2006. The International Application was published in German on Jun. 5, 2008 as WO 2008/064779 under PCT Article 21(2).

FIELD

The present invention relates to a planar-helical undulator enabling the photon radiation emitted therefrom to be electrically variably polarized in a manner which differs from zone to zone along the length of the undulator.

BACKGROUND

The undulator is a light source which emits polarized radiation. To this end, the undulator is positioned along and/or around an accelerator track. The undulator, via the portion of its magnetic field near the axis, acts upon the electrically charged particle beam passing therethrough. Due to its speed $\vec{v}$, the particle beam interacts with the undulator magnetic field $\vec{B}$ in the region of the undulator according to the relation $\vec{v}\times\vec{B}$, a deflecting magnetic field of a certain strength; i.e., a deflecting force, the Lorentz force FL=e $\vec{v}\times\vec{B}$. Undulators are used, in particular, to generate short-wave electromagnetic radiation, mainly X-ray radiation, in synchrotrons. The optical axis of the photon radiation emitted from the undulator is tangential to the particle beam axis.

German document DE 103 58 225 describes an undulator and method of operation thereof. The introductory description of that document includes a description of the prior art and of the physical idea underlying the construction of a special undulator which includes at least two subassemblies. The described undulator, by means its magnetic field and the particle beam passing therethrough, generates synchrotron radiation; each partial undulator including a superconductive material which, when energized with a current, generates an undulator field which is perpendicular to the direction of the current; and the superconductive material in the individual partial undulators being disposed in such a manner that the undulator fields generated by the partial undulators are not parallel to each other. In addition to the explanation of the physical principles of construction, the disclosure describes an undulator coil having two sections of equal length: an inserted planar section and a surrounding helical section. FIG. 2 of DE 103 58 225 shows the planar-helical undulator having two identical coils whose planar and helical sections have an equal number of winding chambers and windings, and in which the planar section is coincidently surrounded by the helical section. There, the planar and helical sections are identical in length. A superconducting planar-helical undulator with electrically switchable helicity is described by U. Schindler in scientific report No. FZKA 6997 of the Karlsruhe Research Institute in Germany, in particular in Chapter 4, entitled "Superconducting Undulators". In section 4.4 "Technical Implementation" and to A.4. "Engineering Drawings", pages 45 and 46 the winding technique is illustrated, including the overpass and underpass of the winding wire (FIG. 4.9, of the electrical series connection of the wound winding chamber and the antiparallelism of the axes of the magnetic fields of successive, wound winding chambers of the respective section of a coil. The configurations of a planar and a helical coil form is illustrated in FIG. 4.10 and FIG. 4.11, and on pages 45 and 46. One coil of the undulator is obtained from the other by rotation through 180° about the undulator axis. This planar-helical undulator is capable of generating X-ray radiation with electrically variable polarization and is configured as follows:

Two coils of the same type are located opposite and equidistant from one another with respect to the undulator axis and are at the same distance from the undulator axis which, in the installed condition, forms part of the synchrotron beam axis. A coil including two sections, namely a helical section and a planar section, the planar section being inserted and positioned in the helical section. The sections each include a coil form made of non-magnetic material, and winding chambers which are milled into the coil form about the coil axis. The planar coil form axis coincides with the helical coil form axis, both forming, or lying on, the coil axis.

The coil axis extends through the planar winding chambers at a right angle thereto, while similarly the helical coil axis extends through the helical winding chambers at an angle of 45° thereto. The distances between the successive winding chambers, the structural period length $\gamma_b$, are the same in both coil forms. The undulator axis and the coil axes are parallel to each other and extend in one plane, the plane of axes.

The bottom of each winding chamber, the winding base, is convex and, more specifically, circular in the case of the inserted planar section. The point in the winding base at which the radius of curvature is largest or, in the case of the helical section, the region of largest radius of curvature, is closest to the undulator axis in central relationship to the plane of axes. The two sections of a coil are positioned relative to each other such that a planar winding chamber and a surrounding helical winding chamber at the same axial location intersect each other twice in the plane of axes in skew relationship to each other, and that they are closest to each other at their respective regions that are closest to the undulator axis. There, the maximum radius of curvature of the winding chamber of the inserted section is no greater than that of the winding chamber of the surrounding winding chamber, the two winding chamber planes forming an angle $\alpha$ of 45°.

A section includes an inlet region and an outlet region for the winding wire on the shell in the region of one end face, and a winding wire connection on the shell in the region of the other end face, the winding chamber region being located therebetween. A section is made in one piece or, for a small number of winding chambers, it is composed of the two end face regions or, for a larger number of winding chambers, it is composed of the two end face regions and at least one chamber region located therebetween; the at least two section components being joined by axial connecting elements in a section-forming manner.

The winding wire is a normal electrical conductor or a technical superconductor and is used to wind a section under a permanent preset tension, always in the same winding direction, as follows: A first length of winding wire extends in a form-fitting, embedded manner from the winding wire inlet across the shell to the winding base of the first winding chamber and passes under the same in a form-fitting, embedded manner. Then, it penetrates the shell to the next, second winding chamber where it extends to the winding base and is wound up therein. From there, the winding wire penetrates the shell to the next, third winding chamber where it extends to the winding base and passes under the same in a form-fitting, embedded manner. Further, the winding wire penetrates the shell to the winding base of the next, fourth winding chamber in which it is wound up in the same direction as before. This procedure is continued until the last even-numbered winding chamber is reached. If this is the last winding chamber, the winding wire is wound up therein and connected to the winding wire connection or, if the last winding chamber is odd-numbered, the winding wire passes under this last winding chamber and connects to the winding wire connection.

A second length of winding wire extends in a form-fitting, embedded manner from the winding wire outlet across the shell to the winding base of the first winding chamber and is wound up therein in the same direction as in the even-numbered winding chambers. Then, it penetrates the shell to the second winding, passes over the same, then penetrates the shell to the third winding chamber where it extends to the winding base and is wound up therein in the same direction as before. Then, it penetrates the shell to the fourth winding chamber, passes over the same, then penetrates the shell to the fifth winding chamber where it extends to the winding base and is wound up therein. This procedure is continued until the last even-numbered winding chamber is reached, from where the winding wire passes over the even-numbered winding and connects to the winding wire connection. The underpasses and overpasses, as well as the conductor terminals and connections, are arranged in the coil form region facing away from the undulator axis. Since the two lengths of winding wire are connected to one another, the windings are electrically in series, but when energized, they generate magnetic fields whose successive axes extend in opposite directions; in the case of the helical section, they extend in opposite parallel directions. The number of windings in the winding chambers of a section is constant.

Moreover, means are provided which allow the current levels applied to the superconducting material in the individual partial undulators to be adjusted independently of one another, as a result of which the undulator field resulting from the superposition of the undulator fields generated by the partial undulators determines the polarization direction of the synchrotron radiation. To this end, a first partial undulator is disposed such that its first undulator field is substantially perpendicular to the direction of the particle beam, and a second partial undulator is disposed such that its second undulator field has a component different from zero in the direction of the first undulator field and another such component in a direction which is substantially perpendicular to the direction of the first undulator field and substantially perpendicular to the direction of the particle beam.

In the FZKA 6997 report, the section-dependent polarization is described in detail for the situation where the sections are of equal length, the planar section is located centrally and has circular winding chambers, and where the number of windings in the winding chambers is constant in both sections, respectively, and thus, the described section-dependent polarization is directly transferable to the zones of the planar-helical undulator having both sections. The portions of the planar-helical undulator that have only the two planar sections generate only linearly polarized light. Conversely, the portions of the planar-helical undulator that have only the two helical sections generate only light having generally elliptical polarization The technical problem consists in the manufacture of an undulator and, thus, in the implementation of the windings of such an undulator. Superconducting undulators, in particular, make it possible to achieve high magnetic field strengths and high field gradients, enabling reliable operation without degradation or spontaneous transition from superconduction to normal conduction, which is known as quenching or quenching effect. The physics described in German document DE 103 58 225 gives rise to the object of providing an undulator which is made of electromagnetic components and allows the desired polarization of the light emitted from the undulator to be adjusted only by changing the current in the conductor sections that generate the undulator magnetic field, and not by means of mechanically/locally moved undulator portions. The above-cited scientific report No. FZKA 6997 describes the technical solution for the purely linear, circular, generally elliptical polarization, and provides structural details of the coil forms. However, the planar-helical undulator described therein is only capable of producing one of the three aforementioned types of polarization in the emitted beam, depending on the setting of the currents in the two coils, with a polarization of the photon radiation emitted therefrom which is electrically completely variable over 360°. It is technically difficult to produce a polarization that differs from zone to zone.

SUMMARY

An aspect of the present invention provides a planar-helical undulator that can similarly be used to select only linear, only circular, or only elliptical polarization, and additionally or alternatively provides a planar-helical undulator that causes the emitted light beam, the synchrotron light from the undulator, to be polarized in a manner which differs from zone to zone.

In an embodiment, the present invention provides a planar-helical undulator for emitting 360° electrically variable photo radiation. The planar-helical undulator includes a first coil and a second coil disposed opposite and equidistant from each other relative to an undulator axis, an axis of the first coil and an axis of the second coil and the undulator axis being parallel to each other so as to extend in a plane of axes, the first and second coils being of a same type, and the undulator axis forming a portion of a synchrotron beam axis. Each of the first and second coils includes a helical section and a planar section, each section having windings disposed in winding chambers, the winding chambers being disposed in succession so that the windings are disposed apart by a distance γb. The windings of each respective section are electrically connected in series, so that the planar section generates, when energized, a first magnetic field having an axis opposite to an adjacent magnetic field axis, and so that the helical section generates, when energized, a second magnetic field having an axis opposite and parallel to an adjacent magnetic field axis. A bottom of each winding chamber is convex, and a region of a winding base having a largest radius of curvature is disposed nearest to the undulator axis. A number of winding chambers of each planar section is two or more, and a number of winding chambers of each helical section is even and is two or more. The helical section and the planar section of each coil have an equal number of winding chambers. The helical section and the planar section of each coil are equal in length, each planar section includes circular ring-shaped winding chamber, the helical section and the planar section of each coil have a constant number of windings, and each planar section is disposed around the corresponding helical section. At least one of the helical section and the planar section of at least one of the coils includes variable windings changing symmetrically over a length of the respective section towards a middle of the respective section.

BRIEF DESCRIPTION OF THE DRAWINGS

The present invention of the planar-helical undulator will now be explained with reference to the drawings for the embodiment of different section lengths. In this connection, emphasis is placed, in particular, on the case of the helical section having the, as explained, necessary even number of winding chambers and the arbitrary integer number, if only >=2, for example, odd number, of winding chambers in the planar section. Other possible designs of the planar-helical undulator that are claimed will be apparent therefrom. The following figures are presented:

DETAILED DESCRIPTION

Figure 1:
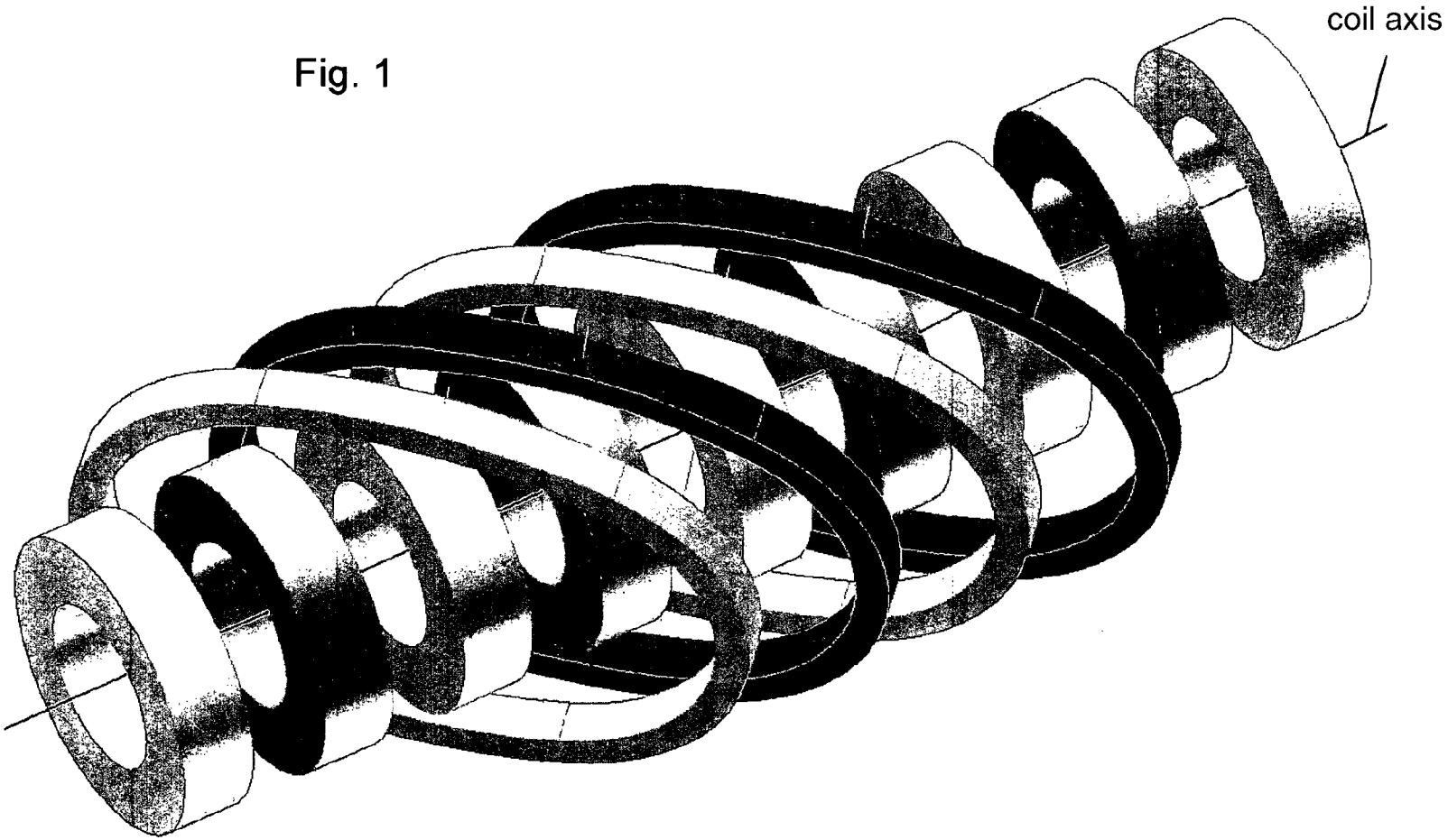
FIG. 1 shows a planar-helical coil having a partially surrounding helical section.

In an embodiment, the undulator components that generate the magnetic field preferably include electrically normally conducting, in particular superconducting solenoidal windings. Moreover, when using superconductors, the intention is to satisfy the constraints in the production of superconducting coils, including at least: suitable superconductors, suitable coil forms, electrical insulation of the winding package, conductor arrangement in the winding chambers, conductor arrangement at the coil inlet and outlet, conductor arrangement at the intersections, coil inlet and outlet, overpasses, Lorentz forces, and quench protection.

In an embodiment according to the present invention, the bottom of each winding chamber is convex (as viewed from outside), and the point or region in the winding base at which the radius of curvature is largest is closest to the undulator axis in central relationship to the plane of axes, and the two sections of a coil have the same or different numbers of winding chambers. In an embodiment having an equal number of winding chambers, the longitudinal regions of the two sections coincide. In the embodiment of an unequal number, the section with the smaller number of winding chambers is located completely within the longitudinal region of the longer section.

In an embodiment where the two sections of a coil are equal in length, the planar section has circular ring-shaped winding chambers, and the number of windings is constant in both sections, respectively, then the planar section is positioned around the helical section. In another embodiment where the sections of a coil are equal in length, the number of windings in the winding chambers is not constant in at least one section of a coil. In that embodiment, however, it changes symmetrically over the length of the section toward the middle thereof. In that embodiment, moreover, the planar section may also be located within the helical section, or vice versa; the planar section surrounds the helical one.

In the embodiment where two sections which are unequal in length, the number of windings in the winding chambers is constant, or the number of windings is not constant in at least one section of the coil, but changes symmetrically over the length of the section toward the middle thereof. This includes that the shorter section is continuous and, thus, includes a portion in the longitudinal region of the long section. It is also possible to arrange short sections in succession in the longitudinal region of the long section. In the embodiment having one short section, it is then possible to create three polarization zones, namely two of the same type which are interrupted by a different polarization zone. In the embodiment having several short sections, the sequence of similar polarization is interrupted by a generally different polarization according to the number of short sections.

The planar sections of the two coils of the planar-helical undulator are capable of generating a magnetic field along and around the undulator/beam axis, said magnetic field being perpendicular to said axis and extending in a periodic, sinusoidal pattern along the undulator axis; i.e., two successive winding chambers have a magnetic field maximum located therebetween, while at the chamber midpoint, the magnetic field generated by it at that position is zero; i.e., the magnetic field changes its direction at that position along the undulator axis. The helical sections of the two coils of the planar-helical undulator generate a magnetic field along and around the undulator/beam axis. The magnetic field is perpendicular to the beam axis and has a planar field component and therefore, as explained above, is periodic. Moreover, it has an additional field component relative to the planar field component and to the beam axis, said additional field component extending also in a periodic, but cosinusoidal pattern along the undulator axis; i.e., two successive helical winding chambers have a zero crossing located therebetween, i.e., a change in direction of the helical field component generated by the successive helical winding chambers. When including the respective planar magnetic field components at the one and at the other end of the two planar and helical sections of the undulator, which each produce a 90°-polarization, for a full 360°-polarization, the number of winding chambers of the planar section is preferably >=2, and the number of winding chambers of the helical section is also preferable to be >=2. The number of winding chambers of the planar section may be even or odd because of the sinusoidal pattern of the magnetic field, because any electrically charged particle passing through the undulator along the beam axis will experience compensation/neutralization of the path deviations it has undergone due to the undulator magnetic field. In the embodiment having the helical sections, the number of winding chambers is restricted in that it is preferably an even number because of the cosinusoidal pattern of the generated magnetic field. This is because the path deviation components due to the two helical end-face fields preferably compensate/neutralize each other; i.e., unlike the sinusoidal magnetic field pattern, these two field components preferably have opposite directions, because, in contrast to the path deviations due to the planar field component, the path deviation components due to the helical magnetic field component between the inlet and outlet of the planar-helical undulator are always compensated/neutralized, even in the embodiment having an odd number.

According to another embodiment, a planar helical undulator is obtained by rotating one undulator coil through 180° about the beam or undulator axis. Thus, it is made of two coils having planar and helical sections. According to another embodiment, the position of one coil is symmetrical to the other one with respect to the undulator axis. However, this embodiment preferably does not use two similar coils, but preferably uses two coils that are of the same type but not identically constructed, because then the helical section in one coil is mirror-inverted relative to the coil axis of the other one of the other coil. Attention should be paid to the electric current supply to the two helical sections in order to achieve the required addition of the magnetic fields between the two coils so as to obtain a helical magnetic field component of the undulator field. In order to generate the magnetic field, the current through the mirrored helical section flows in the opposite direction of the current through the rotated helical section.

The positional arrangement of the two coils of the planar-helical undulator with respect to each other can also be accomplished in two different ways. According to another embodiment, the two coils of the undulator are not mechanically coupled to each other, but individually anchored in their environment in an aligned manner. According to another embodiment, the two coils are mechanically coupled to each other in a positionally accurate manner, maintaining a passageway for the electrically charged particle beam, or the electron beam, passing therethrough, and in such a way that the planar-helical undulator is in its entirety aligned with respect to the beam axis path.

According another embodiment, the coil form is made of dielectric and/or metallic material. Depending on the design, a coil form may be composed of one or the other or a combination of coil form components.

According to another embodiment, the winding wire is round, usually circular or rectangular in cross-section having a predefined aspect ratio. In the latter embodiment, the conductor used for the winding in the winding chamber may even have a pronounced ribbon shape. According to another embodiment, the winding wire is electrically normally conducting. According to another embodiment, possibly only the contact at the winding inlet, winding outlet, and the winding wire connection may be normally conducting. According to another embodiment, the winding wire is a technical superconductor. According to another embodiment, the technical superconductor may be a monolithic multifilament conductor, a stranded conductor, or a cable conductor, and may be made, for example, from NbTi or NbXTi or MgB. According to another embodiment, only the contact at the winding inlet, winding outlet, and the winding wire connection may be superconducting or normally conducting. According to another embodiment, the wire winding in a winding chamber includes at least one layer and at least one conductor. Each layer of a winding has at least one conductor lying therein. In a purely ribbon-shaped winding (pancake), this is the case anyway.

In order to provide a defined magnetic field along and around the beam/undulator axis, provision is made for the winding inlet, winding outlet, the winding wire connection, the underpass at the bottom of the winding chamber, and the overpass over the winding in a winding chamber to be located in the region facing away from the undulator axis; i.e., the influences that the underpasses and overpasses of the winding wire/ribbon have on the configuration of the magnetic field in the aforesaid region will not affect the undulator magnetic field.

According to another embodiment, the two planar sections are traversed by the same current $I_2$ during operation, and the directions of current flow in the planar windings that are opposite to each other with respect to the undulator axis are the same at the passage through the plane of axes. This is best achieved by electrically connecting the two planar sections in series in a suitable manner. Similarly, according to another embodiment, the two helical sections are traversed by the same current $I_1$ during operation, and the directions of current flow in the helical windings that are opposite to each other with respect to the undulator axis are the same at the passage through the plane of axes. There, the two helical sections are traversed by the same current $I_1$ during operation, and the directions of current flow in the helical windings that are opposite to each other with respect to the undulator axis are opposite at the passage through the plane of axes.

If one of the two coils is obtained by rotation of the other through 180° about the undulator/beam axis, and the planar-helical undulator is constructed in this manner, the two section currents $I_1$ und $I_2$ can be adjusted to produce a polarization of the photon radiation emitted from the undulator, said polarization depending on the section length and generally being elliptical, it being possible for the elliptical polarization to be changed in nature circularly and/or to a linear polarization by adjustment of the current. If the planar-helical undulator has a region or regions of only planar sections; i.e., in which it is a planar undulator, then the photon beam generated there is purely linearly polarized. Conversely, a region or regions of only helical sections generates or generate a photon beam that is generally elliptically polarized.

If one of the two coils is obtained by mirroring the other at the plane extending through the undulator/beam axis perpendicularly to the plane of axes, and, therefore, is a planar-helical undulator, at least in some regions, then, the photon radiation emitted from the undulator is either linearly polarized or generally elliptically polarized, depending on the current direction through the respective helical section.

Unlike the prior art, this planar-helical undulator is capable of generating a light beam having different polarizations, depending on the section lengths and section currents. For equal section lengths, there is generally only elliptical polarization. The overall undulator length is limited by the undisturbed divergence of the light beam from the undulator.

In the embodiment having the two similar planar-helical coils, and in the embodiment having the planar-helical coils that are mirror-symmetrical to each other with respect to the undulator axis, the two planar sections in the planar-helical undulator are also electrically connected in series and are connected to a controllable power supply, just as the two helical sections, so that the two magnetic field components that can be generated along and around the undulator/beam axis can be adjusted independently of one another. As for the undulator magnetic field of stationary undulator coils, the addition and subtraction of magnetic fields and the reversal of the direction of the magnetic field can therefore be adjusted as desired just by the setting of the current. Once the two coils are mechanically aligned to form the planar-helical undulator, they remain in this aligned position relative to each other. The following is a description of the manufacture of the superconducting, planar-helical undulator in various design variants, from which additional design variants can be directly developed without difficulty.

FIG. 1 shows the planar-helical coil whose helical section surrounds the planar section. The planar section includes 9, i.e. an odd number of, axially successive circular ring-shaped windings and, within its longitudinal region, is axially non-centrally surrounded by the helical section formed of 4 axially successive, elliptical ring-shaped windings. The planar section is longer than the surrounding helical section, and thus, the two sections are not identical in length. The windings of both sections are equally spaced apart in an axial direction, and the helical winding region, or the two helical winding regions, at which the radius of curvature is largest is or are closest to the winding region of the associated planar winding. In this embodiment, the coil has only 4 planar-helical winding chamber or winding pairs.

Figure 2:
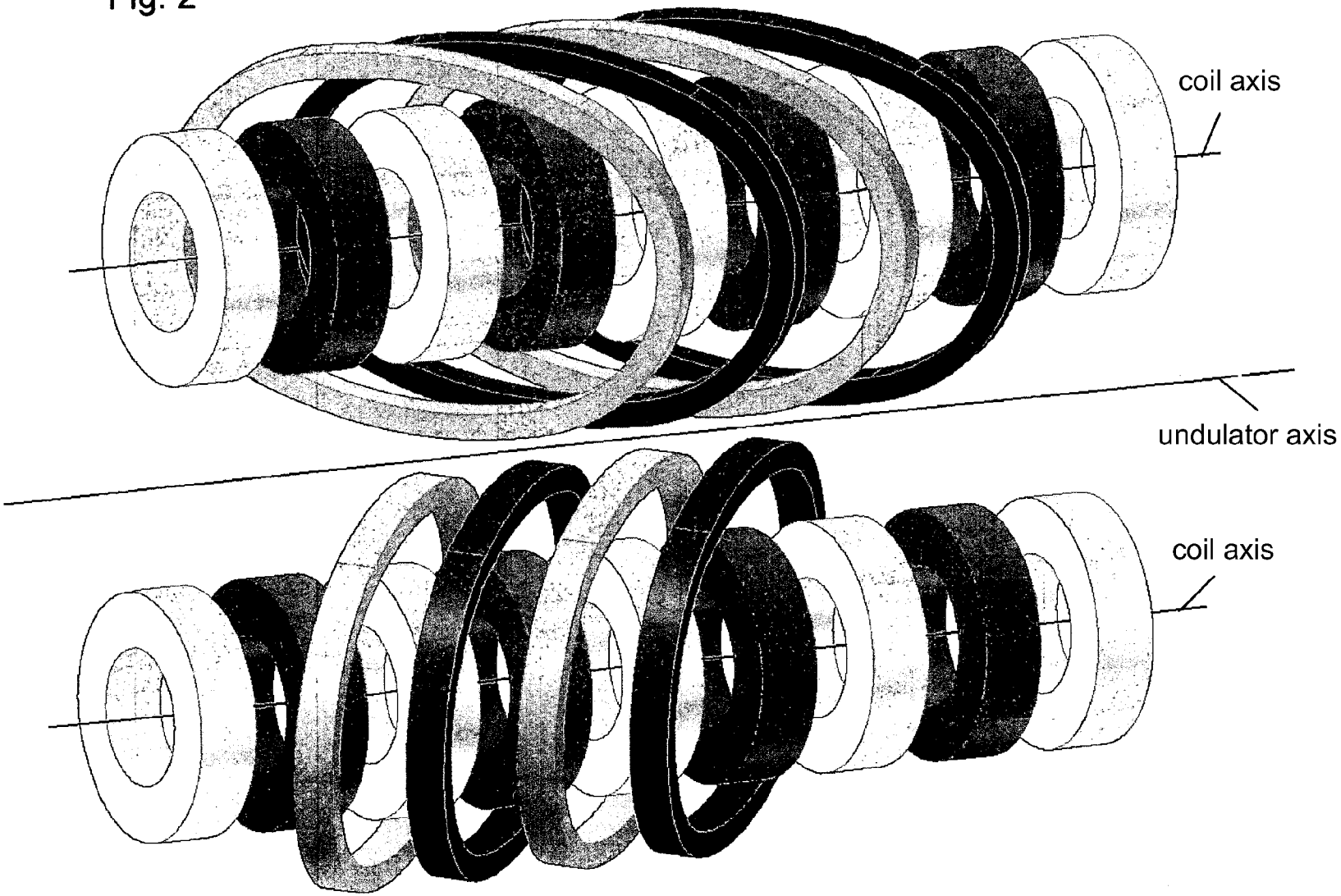
FIG. 2 shows a planar-helical undulator obtained by rotation.
Figure 3:
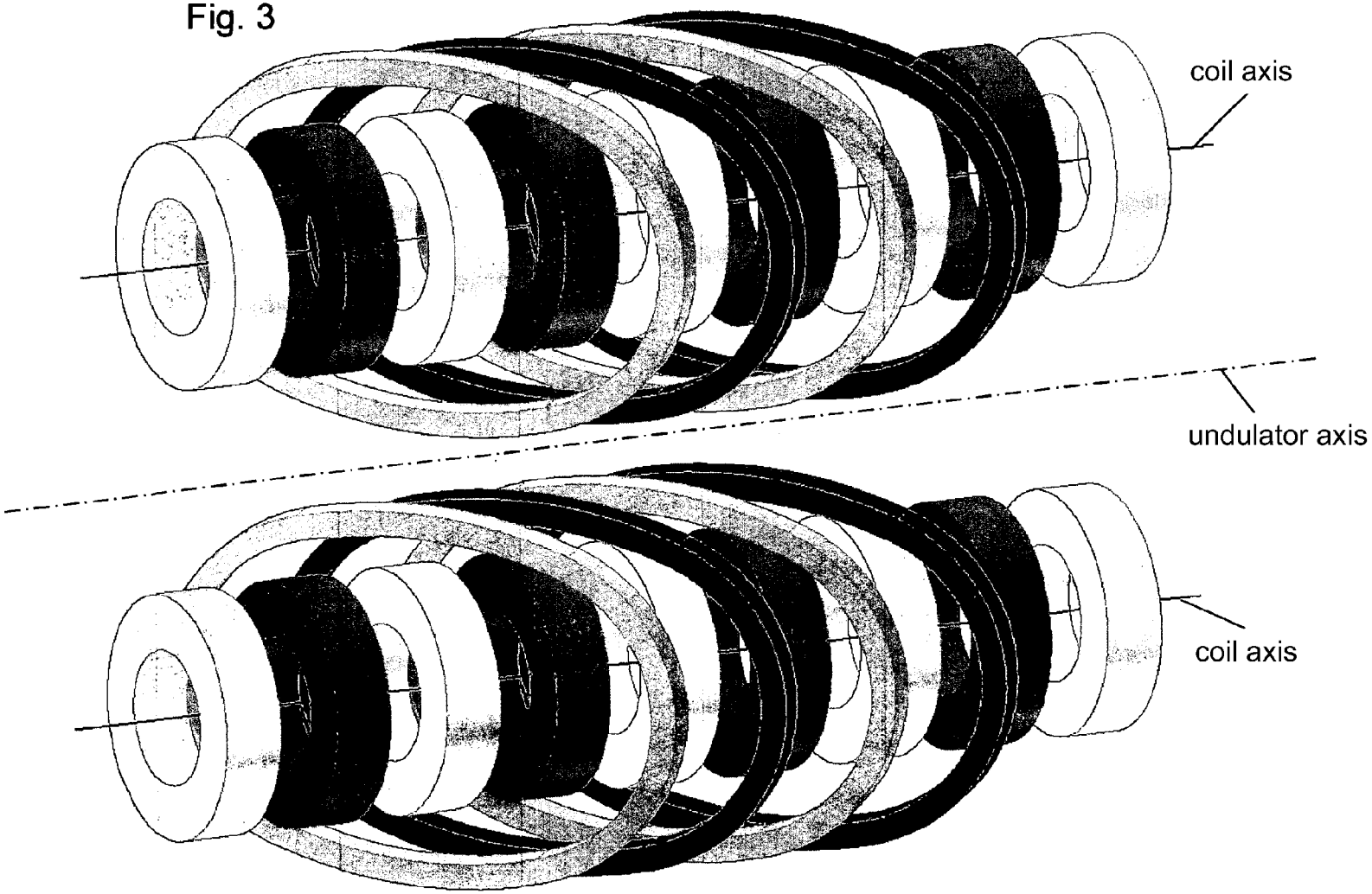
FIG. 3 shows a planar-helical undulator obtained by mirroring.
Figure 4:
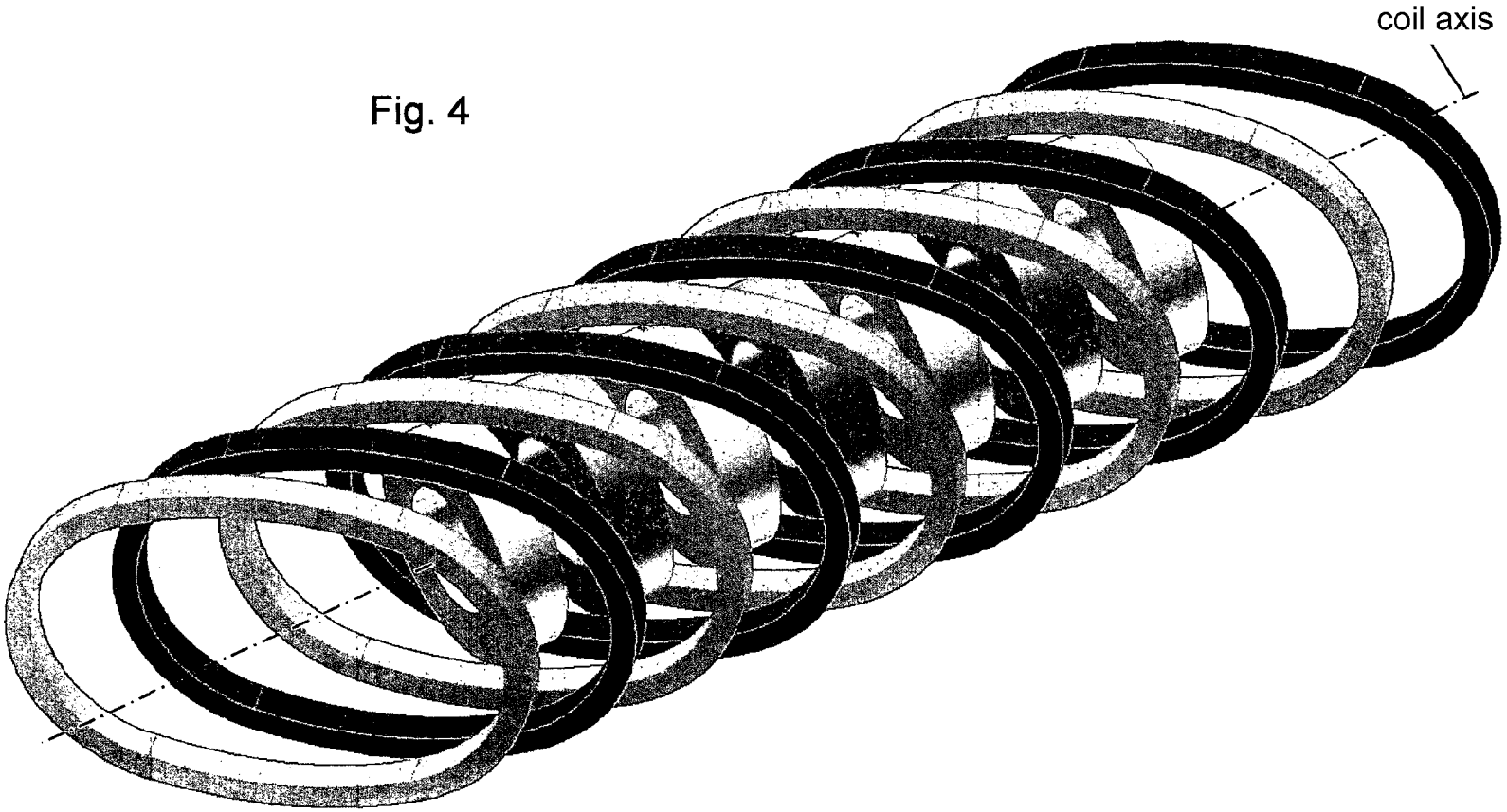
FIG. 4 shows a planar-helical coil having a partially surrounding planar section.
Figure 5:
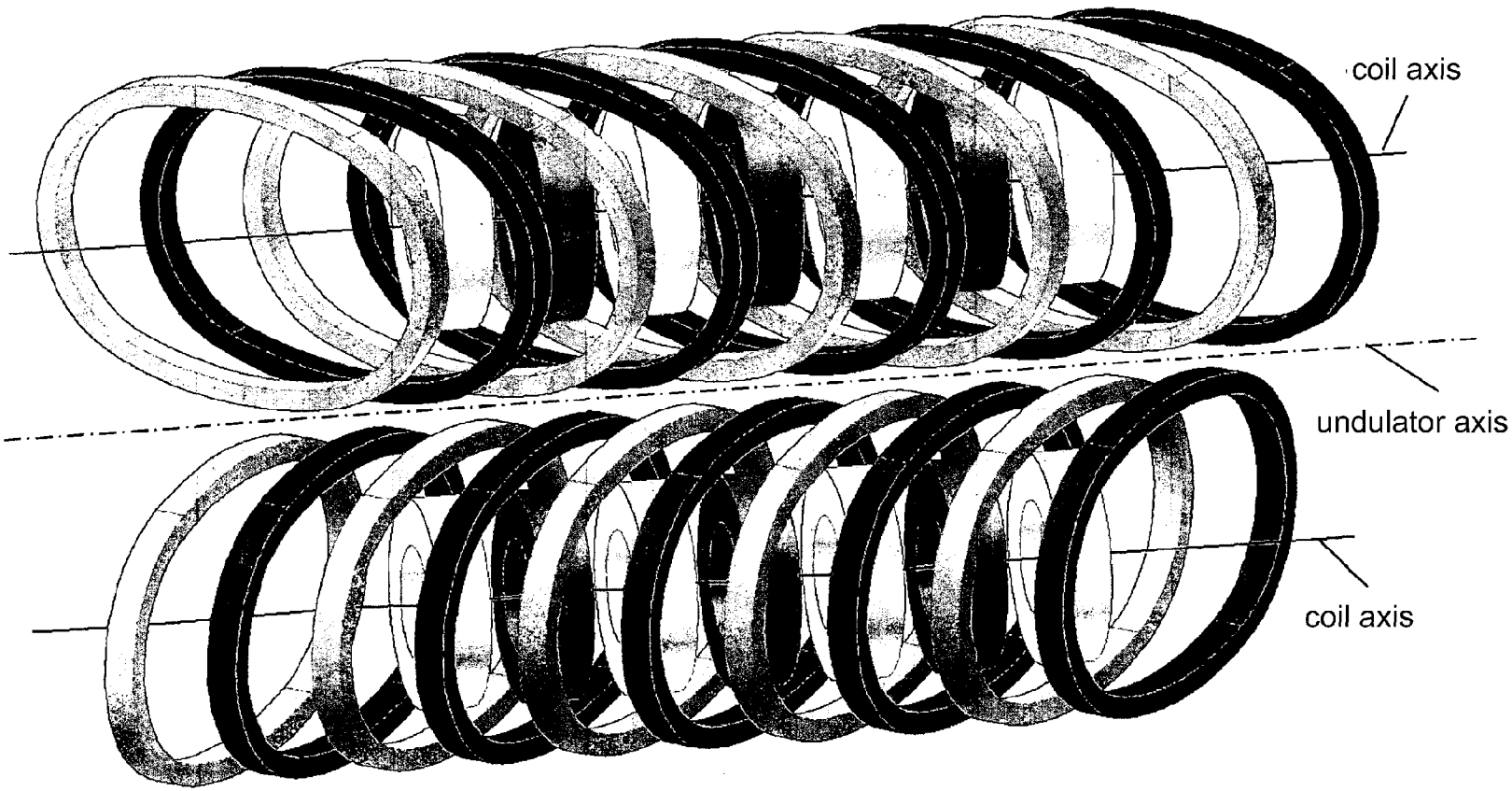
FIG. 5 shows a planar-helical undulator obtained by rotation.

FIG. 2 shows the planar-helical undulator which is assembled from two similar coils as shown in FIG. 1; i.e., rotation of one coil through 180° about the undulator axis produces the other coil. The two coils are similar in construction, each including a planar section and a helical section which differ in length. FIG. 3 shows the planar-helical undulator which is assembled from two coils that are mirror-symmetrical to each other with respect to the undulator axis. The two coils are not identical in construction, each including a planar section and a helical section, which differ in length. In the magnetic field along and around the undulator axis, the electrically charged particles (usually electrons) passing along the undulator axis emit monochromatic or narrow-band X-ray light, the undulator light, in the direction of the particle path, the polarization being different in different zones and, more specifically, the electrons enter the undulator from the left in the image, initially a purely linear polarization in the initially traversed, exposed planar portion, then a generally elliptical polarization in the coinciding planar-helical portion, and finally again a purely linear polarization in the planar portion to the right in the image. Thus, the generated undulator light has a polarization that differs from zone to zone. The polarization zones are determined/defined by the velocity/energy of the electrons passing therethrough, by the length of the exposed planar sections and by the length of the actual planar-helical section; i.e., by the formation of the magnetic field that is perpendicular with respect to the undulator axis and in the region thereof. FIG. 4 shows the planar-helical coil whose helical section also surrounds the planar section. The planar section includes 7 axially successive circular ring-shaped windings and, within its longitudinal region, is axially non-centrally surrounded by the helical section formed of 10 axially successive, elliptical ring-shaped windings. Here, the planar section is shorter than the surrounding helical section, and thus, the two sections are also not identical in length. The windings of both sections are also equally spaced apart in an axial direction, and the helical winding region, or the two helical winding regions, at which the radius of curvature is largest is or are closest to the winding region of the associated planar winding. In this embodiment, however, the coil has 7 planar-helical winding chamber or winding pairs. Here, the helical section of the coil extends beyond the planar section at both ends. The planar-helical undulator is obtained in the manner described above by rotation through 180° about the undulator axis and, thus, is composed of two similarly constructed coils (FIG. 5), or it is obtained by mirroring one coil at the undulator axis and, thus, is composed of two coils which are not identically constructed, but have similar sections. The latter is not illustrated, but is apparent from FIG. 3. In this undulator, the electrical charge carriers/electrons passing therethrough produce a light beam which is tangential to the electron beam axis and includes a sequence of portions which are polarized elliptically, then elliptically or linearly, and then elliptically. The elliptical polarization can, in particular, also be circular.

Figure 6:
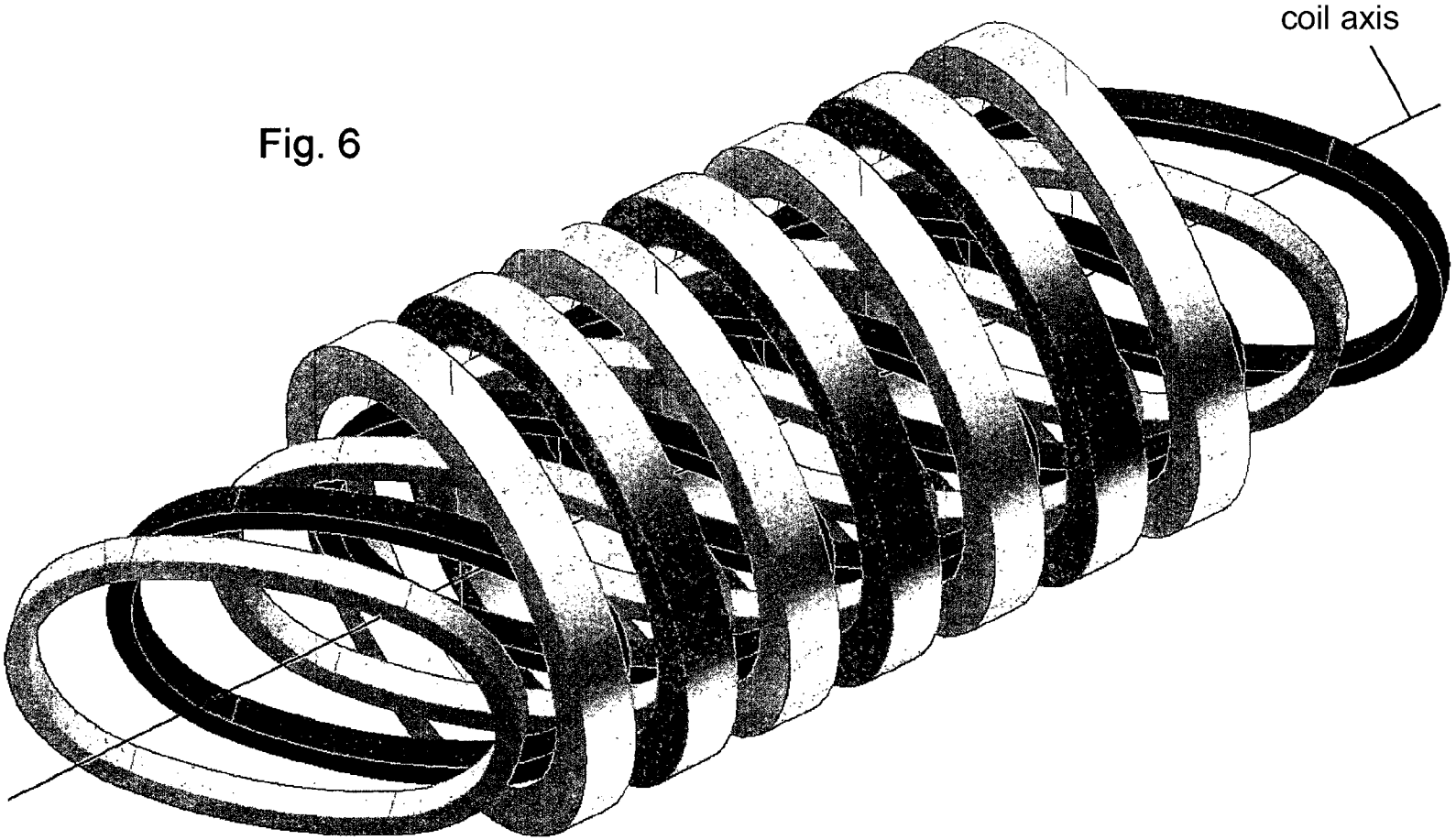
FIG. 6 shows a planar-helical coil having an overlappingly surrounding planar section.
Figure 7:
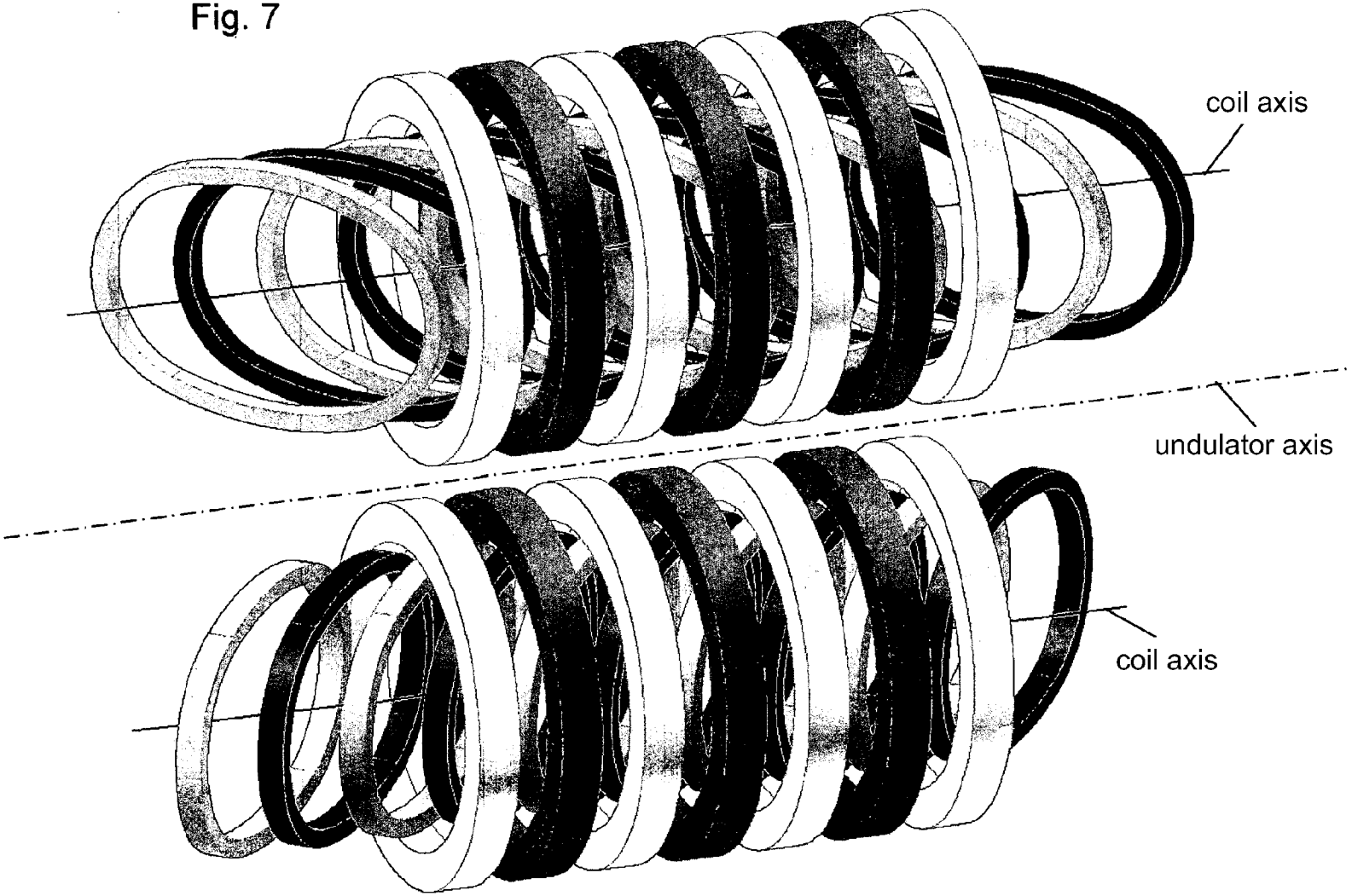
FIG. 7 shows a planar-helical undulator obtained by rotation.

FIG. 6 shows the planar-helical coil whose helical section is surrounded by the planar section. Here, the planar section includes 7 axially successive, elliptical ring-shaped windings, i.e., winding chambers having elliptical winding bases, which, within the longitudinal region, lies axially non-centrally the helical section which is here formed of 10 axially successive, also elliptical ring-shaped windings. The planar section is shorter than the helical section centrally located therewithin. Here too, the two sections of the coil are not identical in length. The windings of both sections are equally spaced apart in an axial direction, and the helical winding region, or the two helical winding regions, at which the radius of curvature is largest is or are closest to the winding region of largest radius of curvature of the associated planar winding. In this embodiment, the coil has 7 planar-helical winding chamber or winding pairs. Here too, the planar-helical undulator formed therefrom, which is shown in FIG. 7, is created by two similarly constructed coils in the two ways described above (rotation through 180°). (The option of obtaining the undulator by mirroring is not shown for this embodiment). In this undulator, the electrical charge carriers/electrons passing therethrough produce a light beam which is tangential to the electron beam axis and includes a sequence of portions which are polarized elliptically, then elliptically or linearly, and then elliptically. Again, the elliptical polarization can, in particular, also be circular.

Figure 8:
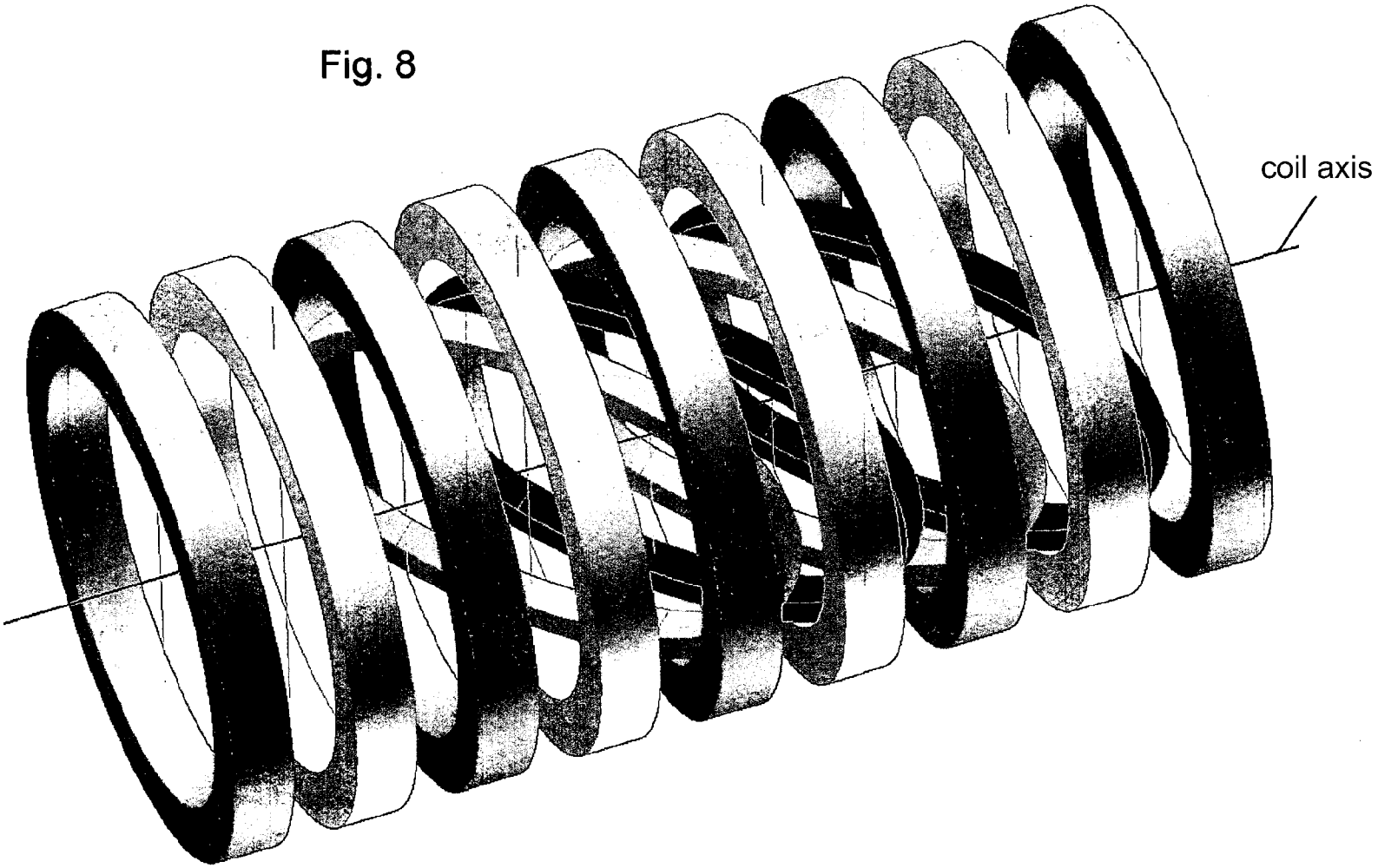
FIG. 8 shows a planar-helical undulator coil having an overlappingly surrounding helical section.
Figure 9:
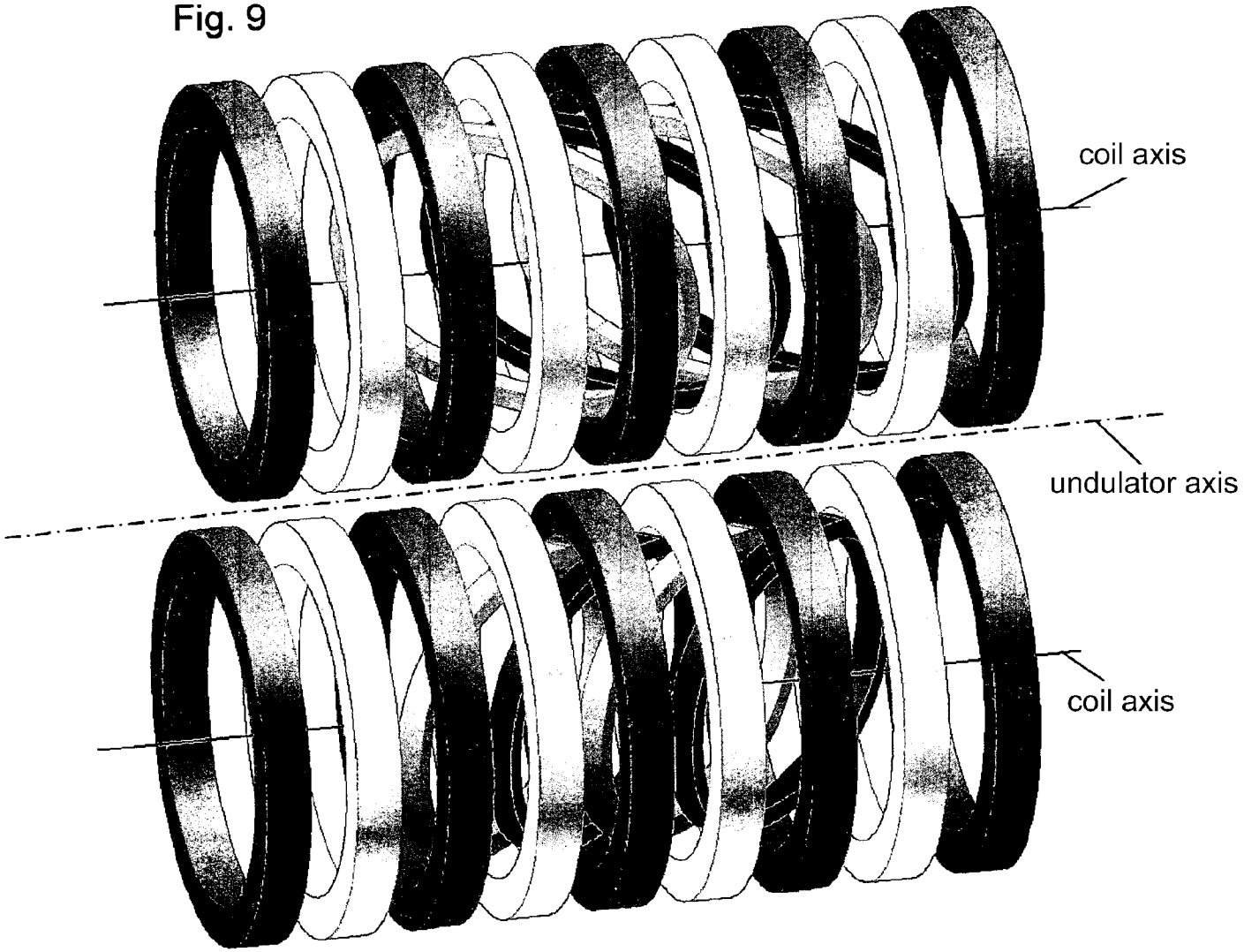
FIG. 9 shows a planar-helical undulator obtained by rotation.

Finally, FIG. 8 shows the planar-helical coil whose helical section is surrounded by the planar section. Here, the planar section includes 9 axially successive, elliptical or circular ring-shaped windings, i.e., winding chambers having elliptical winding bases, which axially non-centrally extend at both ends beyond the longitudinal region of the helical section in an axial direction, the helical section being formed of 4 axially successive, also elliptical ring-shaped windings. The planar section is longer than the helical section centrally located therewithin. The two sections of the coil are not identical in length. The windings of both sections are equally spaced apart in an axial direction, and the helical winding region, or the two helical winding regions, at which the radius of curvature is largest is or are closest to the winding region of largest radius of curvature of the associated planar winding. Here again, the coil has 4 planar-helical winding chamber or winding pairs. Here too, the planar-helical undulator is created in the two ways described above by two similarly constructed coils or by two differently constructed coils. FIG. 9 only illustrates the creation of the undulator by rotation through 180°. In this undulator, the electrical charge carriers/electrons passing therethrough produce a light beam which is tangential to the electron beam axis and includes a sequence of portions which are polarized linearly, then settably elliptically or linearly, and then planarly. The settably elliptical polarization can, in particular, also be circular.

The use of a coil which is very long in relation to structural period length $\gamma_b$ makes it possible to construct a planar-helical undulator to produce a light beam having more than 2 zones of purely linear polarization or purely elliptical polarization, depending on the coil design. See the above comment on a plurality of axially successive small sections in the longitudinal region of a very long section. In the longitudinal region of the very long planar section, for example, there were then more than two helical sections or vice versa, actually an axial sequence of more than two planar-helical undulators—a technically complex device. A natural limitation of the overall undulator length consists in the divergence of the light beam produced in it, in particular, in the input region thereof.

The present invention is not limited to the embodiments described herein; reference should be had to the appended claims.

What is claimed is:

1. A planar-helical undulator for emitting 360° electrically variable photo radiation, comprising:

a first coil and a second coil disposed opposite and equidistant from each other relative to an undulator axis, an axis of the first coil and an axis of the second coil and the undulator axis being parallel to each other so as to extend in a plane of axes, the first and second coils being of a same type, and the undulator axis forming a portion of a synchrotron beam axis;

wherein each of the first and second coils includes a helical section and a planar section, each section having windings disposed in winding chambers, the winding chambers being disposed in succession so that the windings are disposed apart by a distance $\gamma_b$;

wherein the windings of each respective section are electrically connected in series, so that the planar section generates, when energized, a first magnetic field having an axis opposite to an adjacent magnetic field axis, and so that the helical section generates, when energized, a second magnetic field having an axis opposite and parallel to an adjacent magnetic field axis;

wherein a bottom of each winding chamber is convex, and a region of a winding base having a largest radius of curvature is disposed nearest to the undulator axis;

wherein a number of winding chambers of each planar section is two or more, and a number of winding chambers of each helical section is even and is two or more;

wherein the helical section and the planar section of each coil have an equal number of winding chambers; and wherein the helical section and the planar section of each coil are equal in length, each planar section includes a circular ring-shaped winding chamber, the helical section and the planar section of each coil have a constant number of windings, and each planar section is disposed around the corresponding helical section.

2. The planar-helical undulator as recited in claim 1, wherein the second coil is disposed rotated 180° relative to the first coil about the undulator axis.

3. The planar-helical undulator as recited in claim 1, wherein the first coil and the second coil are disposed as mirror-inverter relative to each other with respect to the undulator axis.

4. The planar-helical undulator as recited in claim 2, wherein the first coil and the second coil maintain a distance from each other.

5. The planar-helical undulator as recited in claim 2, wherein the first coil is mechanically coupled to the second coil.

6. The planar-helical undulator as recited in claim 4, wherein each coil includes at least one of a dielectric and a metallic material.

7. The planar-helical undulator as recited in claim 6, wherein each winding includes winding wire having at least one of a round and rectangular cross-section having a predefined aspect ratio.

8. The planar-helical undulator as recited in claim 7, wherein the winding wire is ribbon-shaped.

9. The planar-helical undulator as recited in claim 7, wherein the winding wire is electrically normally conducting.

10. The planar-helical undulator as recited in claim 9, wherein a contact at a winding inlet and a winding outlet of each winding are normally conducting.

11. The planar-helical undulator as recited in claim 10, wherein the winding wire is a superconductor.

12. The planar-helical undulator as recited in claim 11, wherein the superconductor includes at least one of NbTi, NbXTi, and MgB, and is one of a monolithic multifilament conductor, a stranded conductor, or a cable conductor.

13. The planar-helical undulator as recited in claim 12, wherein the contact at the winding inlet, the winding outlet, and the winding are one of superconducting or normally conducting.

14. The planar-helical undulator as recited in claim 13, wherein the winding in the winding chamber includes at least one layer and at least one conductor.

15. The planar-helical undulator as recited in claim 14, wherein the winding inlet, the winding outlet, the winding, an underpass at a bottom of the winding chamber and an overpass over the winding in the winding chamber are disposed in a region facing away from the undulator axis.

16. The planar-helical undulator as recited in claim 14, wherein during operation a current $I_1$ flows through the two helical sections, a direction of the current flowing in the respective helical sections being opposite to each other with respect to the undulator axis and the directions being the same at the plane of axes.

17. The planar-helical undulator as recited in claim 14, wherein during operation a current $I_1$ flows through the two helical sections, a direction of the current flowing in the respective helical sections being opposite to each other with respect to the undulator axis and the directions being opposite at the plane of axes.

18. The planar-helical undulator as recited in claim 15, wherein during operation a current $I_2$ flows through the two planar sections, a direction of the current flowing in the respective planar sections being opposite to each other with respect to the undulator axis and the directions being the same at the plane of axes.

19. The planar-helical undulator as recited in claim 18, wherein during operation a current $I_1$ flows through the two helical sections, a direction of the current flowing in the respective helical sections being opposite to each other with respect to the undulator axis and the directions being the same at the plane of axes, and wherein the second coil is disposed rotated 180° relative to the first coil about the undulator axis so that the emitted photon radiation is elliptically polarized via the two currents $I_1$ and $I_2$.

20. The planar-helical undulator as recited in claim 18, wherein during operation a current $I_1$ flows through the two helical sections, a direction of the current flowing in the respective helical sections being opposite to each other with respect to the undulator axis and the directions being the same at the plane of axes, and wherein the first coil and the second coil are disposed as mirror-inverter relative to each other with respect to the undulator axis so that the emitted photon radiation is linearly polarized via the two currents $I_1$ and $I_2$.

21. The planar-helical undulator as recited in claim 18, wherein during operation a current $I_1$ flows through the two helical sections, a direction of the current flowing in the respective helical sections being opposite to each other with respect to the undulator axis and the directions being the same at the plane of axes, and wherein the first coil is disposed as a mirror image of the second coil relative to a plane extending perpendicular to the plane of axes so that the emitted photon radiation is elliptically polarized via the two currents $I_1$ and $I_2$.

22. A planar-helical undulator for emitting 360° electrically variable photo radiation, comprising:

a first coil and a second coil disposed opposite and equidistant from each other relative to an undulator axis, an axis of the first coil and an axis of the second coil and the undulator axis being parallel to each other so as to extend in a plane of axes, the first and second coils being of a same type, and the undulator axis forming a portion of a synchrotron beam axis;

wherein each of the first and second coils includes a helical section and a planar section, each section having windings disposed in winding chambers, the winding chambers being disposed in succession so that the windings are disposed apart by a distance $\gamma_b$;

wherein the windings of each respective section are electrically connected in series, so that the planar section generates, when energized, a first magnetic field having an axis opposite to an adjacent magnetic field axis, and so that the helical section generates, when energized, a second magnetic field having an axis opposite and parallel to an adjacent magnetic field axis;

wherein a bottom of each winding chamber is convex, and a region of a winding base having a largest radius of curvature is disposed nearest to the undulator axis;

wherein a number of winding chambers of ach planar section is two or more, and a number of winding chambers of each helical section is even and is two or more;

wherein the helical section and the planar section of each coil have an unequal number of winding chambers so that the section with a smaller number of winding chambers is longitudinally disposed within the corresponding section with a greater number of winding chambers; and wherein the helical section and the planar section of at least one of the coils has a constant number of windings in the winding chambers.

23. A planar-helical undulator for emitting 360° electrically variable photo radiation, comprising:

a first coil and a second coil disposed opposite and equidistant from each other relative to an undulator axis, an axis of the first coil and an axis of the second coil and the undulator axis being parallel to each other so as to extend in a plane of axes, the first and second coils being of a same type, and the undulator axis forming a portion of a synchrotron beam axis;

wherein each of the first and second coils includes a helical section and a planar section, each section having windings disposed in winding chambers, the winding chambers being disposed in succession so that the windings are disposed apart by a distance $\gamma_b$;

wherein the windings of each respective section are electrically connected in series, so that the planar section generates, when energized, a first magnetic field having an axis opposite to an adjacent magnetic field axis, and so that the helical section generates, when energized, a second magnetic field having an axis opposite and parallel to an adjacent magnetic field axis;

wherein a bottom of each winding chamber is convex, and a region of a winding base having a largest radius of curvature is disposed nearest to the undulator axis;

wherein a number of winding chambers of ach planar section is two or more, and a number of winding chambers of each helical section is even and is two or more;

wherein the helical section and the planar section of each coil have an unequal number of winding chambers so that the section with a smaller number of winding chambers is longitudinally disposed within the corresponding section with a greater number of winding chambers; and wherein at least one of the helical section and the planar section of at least one of the coils includes variable windings changing symmetrically over a length of the respective section towards a middle of the respective section.

24. A planar-helical undulator for emitting 360° electrically variable photo radiation, comprising: a first coil and a second coil disposed opposite and equidistant from each other relative to an undulator axis, an axis of the first coil and an axis of the second coil and the undulator axis being parallel to each other so as to extend in a plane of axes, the first and second coils being of a same type, and the undulator axis forming a portion of a synchrotron beam axis; wherein each of the first and second coils includes a helical section and a planar section, each section having windings disposed in winding chambers, the winding chambers being disposed apart in succession so that the windings are disposed apart by a distance $\gamma b$; wherein the windings of each respective section are electrically connected in series, so that the planar section generates, when energized, a first magnetic field having an axis opposite to an adjacent magnetic field axis, and so that the helical section generates, when energized, a second magnetic field having an axis opposite and parallel to an adjacent magnetic field axis; wherein a bottom of each winding chamber is convex, and a region of a winding base having a largest radius of curvature is disposed nearest to the undulator axis; wherein a number of winding chambers of each planar section is two or more, and a number of winding chambers of each helical section is even and is two or more; wherein the helical section and the planar section of each coil have an equal number of winding chambers; and wherein the helical section and the planar section of each coil are equal in length, and at least one of the helical section and the planar section of at least one of the coils includes variable windings changing symmetrically over a length of the respective section towards a middle of the respective section.

* * * * *